US007798248B2

(12) United States Patent
Stauffer

(10) Patent No.: US 7,798,248 B2
(45) Date of Patent: Sep. 21, 2010

(54) ROLLER BEARING SEAL COMPANION RING HAVING TEXTURED SURFACE FOR HOLDING LUBRICANT AND SMALL PARTICLES

(75) Inventor: Bruce Stauffer, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 67 days.

(21) Appl. No.: 12/193,471

(22) Filed: Aug. 18, 2008

(65) Prior Publication Data

US 2010/0038144 A1 Feb. 18, 2010

(51) Int. Cl.
*E21B 10/25* (2006.01)

(52) U.S. Cl. ..... 175/57; 175/371

(58) Field of Classification Search ..... 175/371, 175/57; 384/94

See application file for complete search history.

(56) References Cited

U.S. PATENT DOCUMENTS

| | | | | |
|---|---|---|---|---|
| 4,613,004 | A * | 9/1986 | Shotwell | 175/371 |
| 4,619,534 | A | 10/1986 | Daly et al. | |
| 5,842,700 | A * | 12/1998 | Fang et al. | 277/336 |
| 6,123,337 | A * | 9/2000 | Fang et al. | 277/336 |
| 6,176,331 | B1 * | 1/2001 | Jin et al. | 175/372 |
| 6,536,542 | B1 * | 3/2003 | Fang et al. | 175/371 |
| 7,628,231 | B2 * | 12/2009 | Lin | 175/371 |
| 2003/0029645 | A1 | 2/2003 | Mourik et al. | |
| 2006/0006606 | A1 * | 1/2006 | Smith et al. | 277/500 |
| 2008/0073124 | A1 | 3/2008 | Lin | |
| 2009/0127002 | A1 * | 5/2009 | Lin | 175/336 |

* cited by examiner

*Primary Examiner*—Hoang Dang
(74) *Attorney, Agent, or Firm*—Bracewell & Giuliani LLP

(57) ABSTRACT

A roller cone bit is provided that includes a companion ring positioned exterior to a seal, wherein the companion ring includes a textured surface where the inner diameter of the companion ring contacts the bearing pin.

20 Claims, 3 Drawing Sheets

ROLLER BEARING SEAL COMPANION RING HAVING TEXTURED SURFACE FOR HOLDING LUBRICANT AND SMALL PARTICLES

BACKGROUND OF THE INVENTION

1. Field of the Invention

This invention relates in general to earth-boring rotary cone drill bits and in particular to a protective device for protecting the seal of each cone from damage due to debris.

2. Description of Related Art

Earth-boring bits of the type described herein include a bit body having at least one bearing pin, normally three, and a cone rotatably mounted to each bearing pin. Each cone includes cutting elements for engaging the earth formation as the bit body rotates. The bearing spaces between the cavity of the cone and the bearing pin are typically filled with a lubricant. A seal is located near the mouth of the cone cavity for the purpose of sealing lubricant from drilling fluid.

During typical drilling operations, debris, whether it originates from the drill bit bearing or the bore hole, can find its way to the seal and cause wear, which in turn can eventually lead to the failure of the seal. One type of seal includes an elastomeric member having an inner diameter in sliding engagement with the bearing pin and an outer diameter that is normally in static engagement with the cone. This type of seal can form a nip area with the bearing pin and allows debris to accumulate near and migrate into the sealing interface. The accumulated debris can cause wear and leakage.

Another type of seal used in drill bits employs primary metal-to-metal face seals that are energized by an elastomeric ring. One type of seal assembly employs a secondary elastomeric seal exterior of the energizer ring to protect the primary seal. The secondary seal takes up precious space, and the assembly requires pressure compensation for the space between the two seals.

Other designs use an elastomeric ring that has a more wear-resistant elastomeric layer upon the inner diameter. The more wear-resistant layer may include a different elastomer, or it may be made up of a wear-resistant fabric. This arrangement does not necessarily prevent the migration of debris to the primary, and does not prevent wear and leakage.

Thus, there exists a need to provide an improved seal for a roller cone drill bit whereby wear and leakage may be minimized.

SUMMARY OF THE INVENTION

In this invention, a companion ring having a textured interface on the inner diameter surface is mounted with the texture in sliding engagement with one of the annular surfaces of the seal area for protecting the seal.

In one aspect, an earth boring bit is provided having a bit body that includes a depending bearing pin. The bit includes a cone having a plurality of cutting elements for engaging a bore hole, wherein the cone includes a cavity that rotatably engages the bearing pin. The cone and the bearing pin include a seal area defined by two annular surfaces, one of which rotates relative to the other. The bit includes a seal positioned between the bearing pin and the cone cavity in sealing engagement with the annular surfaces of the seal area; and a companion ring abutting the seal and positioned between the bearing pin and the cone cavity in engagement with the annular surfaces of the seal area, wherein an inner diameter surface of the companion ring includes a textured surface engaging the bearing pin surface.

In one embodiment, the bit includes a recess on a side surface of the seal adjacent to the companion ring and a tab extending outward from the side surface of the companion ring abutting the seal, wherein the tab engages the recess on the side surface of the seal.

In another aspect, an earth boring bit is provided having a bit body that includes a depending bearing pin. The bit includes a cone having a plurality of cutting elements for engaging a bore hole, the cone having a cavity that rotatably engages the bearing pin; and a groove formed in the cavity of the cone. The cone includes a seal in the groove between the bearing pin and the cone, wherein the seal sealingly engages the bearing pin and a companion ring abutting the seal in the groove and located on a drilling fluid side of the seal, wherein the companion ring includes a textured surface on an inner diameter surface of the companion ring, the textured surface in engagement with the bearing pin.

In another aspect, a method of sealing drilling fluid from lubricant in an earth boring drill bit having a cone rotatably mounted on a bearing pin for engaging a borehole is provided, the method including providing a seal area between the cone and the bearing pin defined by two annular surfaces, one of which rotates relative to the other, and mounting a seal and a companion ring between the annular surfaces. The seal and the companion ring include at least one dynamic seal surface, and the companion ring includes a textured surface on the inner diameter surface. The cone is rotated on the bearing pin within a borehole and drilling fluid is sealed in the borehole from lubricant with a dynamic seal surface of the seal and companion ring. Drilling fluid that contacts the companion ring is permitted to migrate past the textured surface into contact with the dynamic seal surface, and at least some debris of the drilling fluid is blocked with the textured surface from reaching the dynamic seal surface.

DETAILED DESCRIPTION

Figure 1:
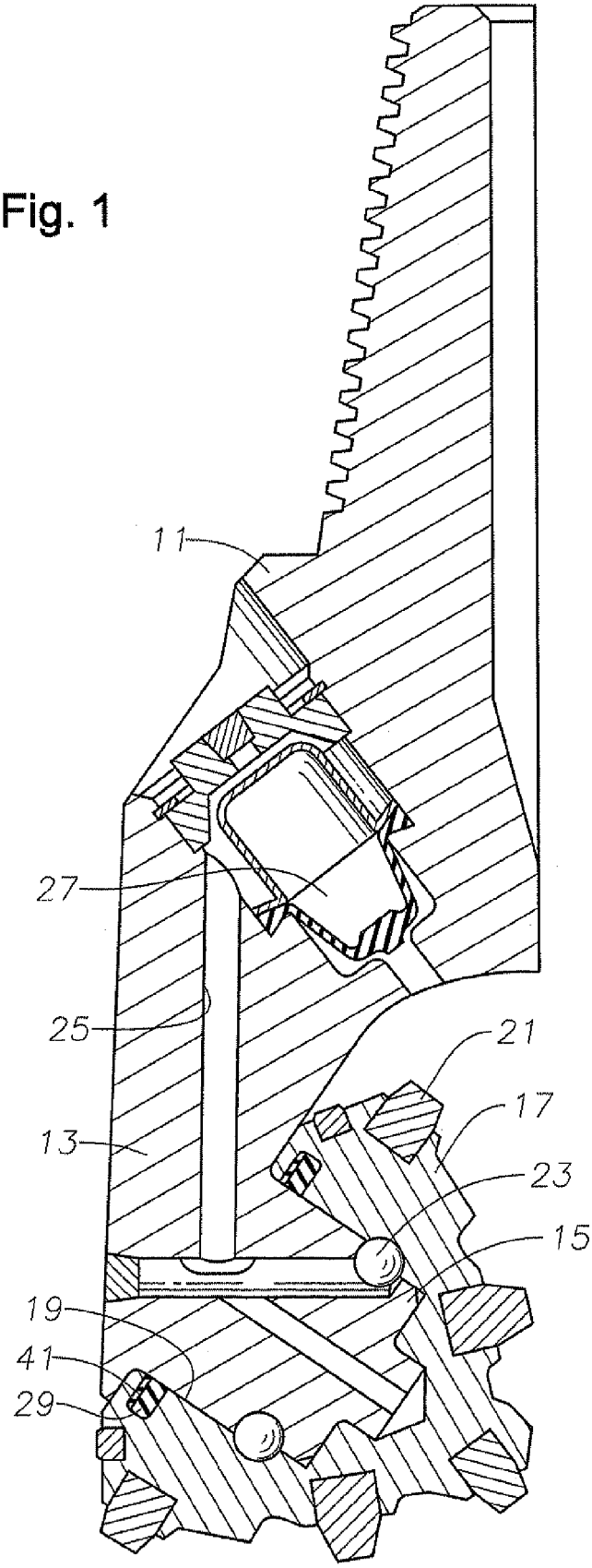
FIG. 1 is a partial cross sectional view of a roller cone drill bit having a seal in accordance with one embodiment of the invention.

Referring to FIG. 1, the drill bit has a bit body 11 that includes at least one bit leg 13. In certain embodiments, the body 11 includes three bit legs 13. A bearing pin 15 depends downward and forward from each bit leg 13 toward the axis of rotation of the bit. A cone 17 has a cavity 19 that slides over bearing pin 15, allowing cone 17 to rotate relative to bearing pin 15. Cone 17 has a plurality of cutting elements 21 on its exterior. Cutting elements 21 may be tungsten carbide inserts pressed into mating holes, or cutting elements 21 may comprise teeth integrally machined from the body of cone 17. Cone 17 is held on bearing pin 15 by a locking element, which in one embodiment includes a plurality of balls 23 located in mating annular grooves of bearing pin 15 in cone cavity 19.

A lubricant passage 25 extends through each bit leg 13 from a compensator 27 to the bearing spaces within cavity 19. A seal 29 and companion ring 41 are provided to seal lubricant within the bearing spaces. Compensator 27 reduces the pressure differential across seal 29, which is exposed to borehole pressure on its rearward side and lubricant pressure on its forward side.

Figure 2:
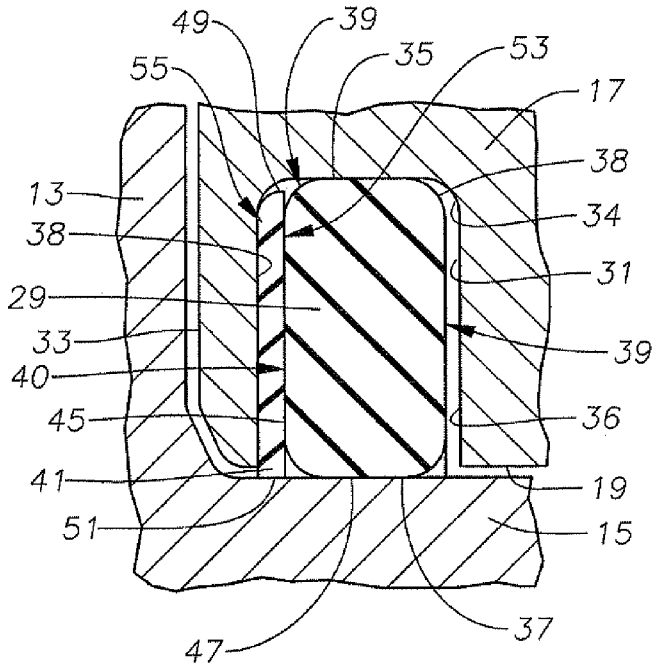
FIG. 2 is a partial cross sectional view of a seal in accordance with one embodiment of the invention.

Referring to FIG. 2, one embodiment of an improved seal is provided. Seal 29 is located within seal groove 31 formed in cone cavity 19. Seal groove 31 is perpendicular to the axis of bearing pin 15 and includes a cylindrical base 34 and parallel flat side walls, which include a forward side surface 36 of the seal groove and a rearward side surface 38 of the seal groove. Seal groove 31 is located a short distance within cavity 19. Cone 17 has a back face 33 that surrounds the mouth of cavity 19. Companion ring 41 is located within seal groove 31 between seal 29 and seal groove exterior side surface 42.

Seal 29 comprises an elastomeric ring having an outer diameter 35 and an inner diameter 37. In certain embodiments, the outer diameter 35 and inner diameter 37 of the seal 29 are generally cylindrical. In certain embodiments, forward side surface 39 and rearward side surface 40 of seal 29 are generally flat. Other shapes for seal 29 are also feasible.

Companion ring 41 comprises an elastomeric ring having an outer diameter 49 that contacts seal groove base 34 and an inner diameter 51 that contacts bearing pin 15. In certain embodiments, outer diameter surface 49 and inner diameter surface 51 are generally cylindrical. In certain embodiments, forward side surface 53 of companion ring 41 and rearward side surface 55 of companion ring are generally flat. Companion ring 41 includes a textured surface 43 at the point on interior diameter surface 51 where companion ring 41 contacts the surface of the bearing pin 15. In certain embodiments, the width of companion ring 41 between forward side surface 53 and rearward side surface 55 is thinner than the width of seal 29. In certain embodiments, the width of companion ring 41 is less than the distance between the outer diameter of the companion ring 49 and the inner diameter of the companion ring 51.

Figure 3:
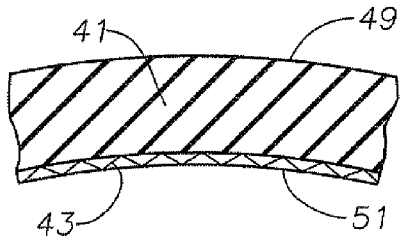
FIG. 3 is a cross sectional view of the seal.

FIG. 3 is a partial sectional view of companion ring 41 taken along the line 3-3 as shown in FIG. 2. As shown, companion ring 41 includes textured surface 43 on inner diameter surface 51.

Figure 6:
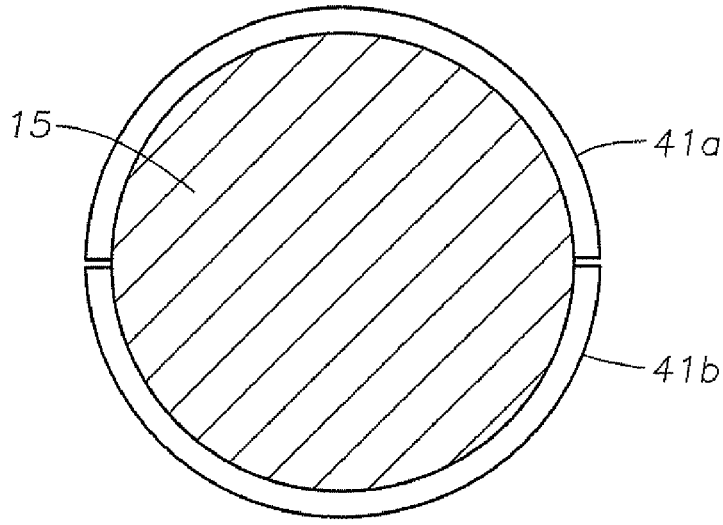
FIG. 6 shows a front elevational view of one embodiment of a companion ring about the bearing pin.

In certain embodiments, seal 29 may include notch or recess 57 in rearward side surface 40 adjacent to companion ring forward side surface 53 adapted to matingly receive pin or tab 59 positioned on forward side surface 53 of companion ring 41. The mating engagement of notch or recess 57 with pin or tab 59 on companion ring 41 allows for seal 29 and companion ring 41 to be coupled to one another. Alternatively, the notch or recess can be located on the forward side surface 53 of companion ring 41 and pin or tab can be located on the rearward side surface 40 of the seal 29. As shown in FIG. 6, in certain embodiments, companion ring 41 is provided as two substantially equal sized semicircles 41*a*, 41*b*, providing for improved engagement and an improved seal.

Figure 4:
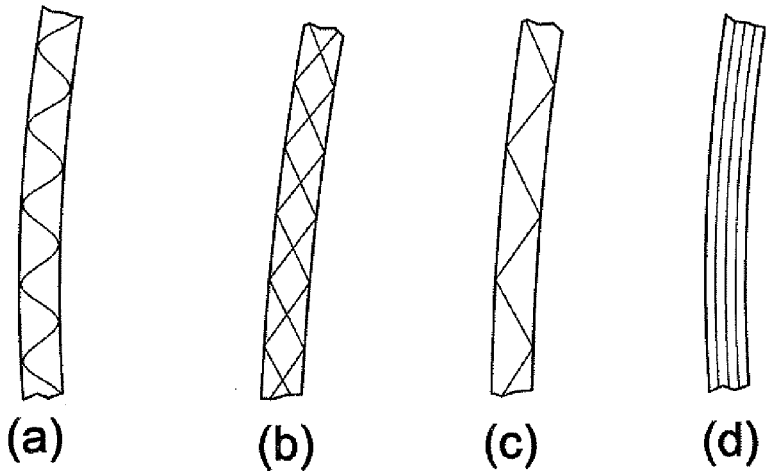
FIG. 4 shows various textures for the edges of the seal.
Figure 5:
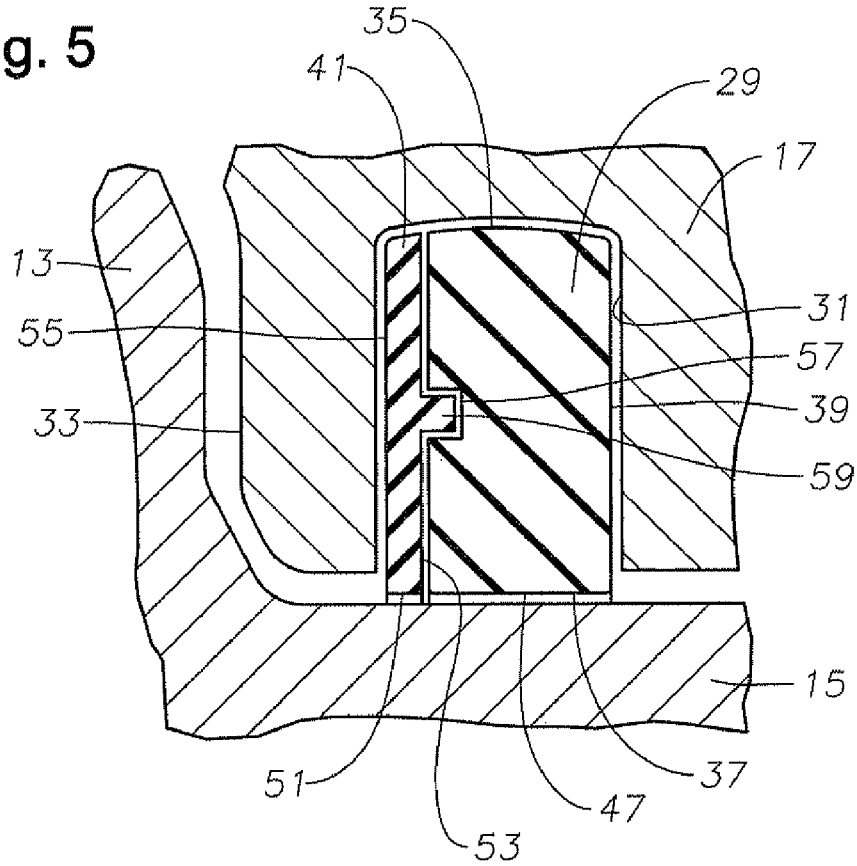
FIG. 5 shows a partial cross sectional view of a seal in accordance with one embodiment of the invention.

A variety of different surface textures can be employed on companion ring 41. For example, as shown in FIG. 4(*a*), in one embodiment, textured surface 43 of companion ring 41 can include one or more undulating or wavy ridges that traverse inner diameter surface 51. In certain embodiments, as shown in FIG. 4(*b*), textured surface 43 includes a plurality of ridges arranged in a pattern that crosses inner diameter surface 51. In certain embodiments, as shown in FIG. 4(*c*), textured surface 43 includes a non-intersecting ridge that traverses the surface of companion ring 41, from forward side surface 53 to rearward side surface 55. In yet other embodiments, as shown in FIG. 4(*d*), textured surface 43 can include a plurality of parallel ridges arranged circumferentially about inner diameter 51 of companion ring 41. In yet another embodiment, textured surface 43 shown in FIG. 4(*d*) can include a plurality of raised ridges perpendicular to the ridges arranged circumferentially about inner diameter 51.

In certain embodiments, textured surface 43 includes a ridge or raised protuberance having a height of less than about 50 microns. In certain embodiments, the height of the ridge or raised protuberance is between about 5 and 200 microns, preferably between about 5 and 100 microns, more preferably between about 10 and 50 microns and even more preferably between about 10 and 30 microns.

In certain embodiments, textured surface 43 is in sliding engagement with the bearing pin. In certain other embodiments, the outer diameter 49 of companion ring 41 is in static engagement with the interior cavity of the cone 17.

It is understood that companion ring 41 can be produced from a variety of materials, depending on the desired properties of the companion ring. In certain embodiments, companion ring 41 is less wear resistant than seal 29. In certain embodiments, companion ring 41 is more wear resistant than seal 29. In certain embodiments, the companion ring is made of Teflon. In certain embodiments, the textured surface can be a ceramic or metal. In certain embodiments, companion ring 41 can be a two piece ring that can be comprised of two substantially equal sized semicircles, which cooperate together to form the seal ring.

In embodiments employing a ceramic companion ring 41, or a ceramic textured surface 43, it is preferably that the dynamic sliding surface is substantially smooth. In yet other embodiments, wherein companion ring 41 is ceramic, or includes a ceramic textured surface, the surface of the bearing pin is substantially smooth.

In certain embodiments, outer diameter 35 of seal 29 and outer diameter 49 of companion ring 41 are approximately equivalent. In certain other embodiments, inner diameter 37 of seal 29 and inner diameter 51 of companion ring 41 are approximately equivalent.

In this embodiment, textured surface 43 of companion ring 41 contacts bearing pin 15. In certain embodiments, companion ring 41 has a width less than seal 29. In certain embodiments, companion ring 41 does not create a seal with bearing pin 15, but instead provides a surface that prevents the unwanted migration of debris into the seal, but allows the passage of fluid. In certain embodiments, textured surface 43 blocks the passage of debris. In other embodiments, textured surface 43 traps debris. In yet other embodiments, textured surface 43 promotes hydrodynamic lubrication of the fluid.

Although the following detailed description contains many specific details for purposes of illustration, one of ordinary skill in the art will appreciate that many variations and alterations to the following details are within the scope and spirit of the invention. Accordingly, the exemplary embodiments of the invention described herein are set forth without any loss of generality to, and without imposing limitations thereon, the present invention.

As used herein, optional or optionally means that the subsequently described event or circumstances may or may not occur. The description includes instances where the event or circumstance occurs and instances where it does not occur.

As used herein, recitation of the term about and approximately with respect to a range of values should be interpreted to include both the upper and lower end of the recited range. Ranges may be expressed herein as from about one particular value, and/or to about another particular value. When such a range is expressed, it is to be understood that another embodiment is from the one particular value and/or to the other particular value, along with all combinations within said range.

As used in the specification and claims, the singular form "a", "an" and "the" may include plural references, unless the context clearly dictates the singular form.

Although the following detailed description contains many specific details for purposes of illustration, one of ordinary skill in the art will appreciate that many variations and alterations to the following details are within the scope of the invention. Accordingly, the exemplary embodiments of the invention described below are set forth without any loss of generality to, and without imposing limitations thereon, the claimed invention.

Throughout this application, where patents or publications are referenced, the disclosures of these references in their entireties are intended to be incorporated by reference into this application, in order to more fully describe the state of the art to which the invention pertains, except when these reference contradict the statements made herein.

The invention claimed is:

1. An earth boring bit, comprising:

a bit body having a depending bearing pin;

a cone having a plurality of cutting elements for engaging a bore hole, the cone having a cavity that rotatably engages the bearing pin, the cone and the bearing pin having a seal area defined by two annular surfaces, one of which rotates relative to the other;

a seal positioned between the bearing pin and the cone cavity in sealing engagement with the annular surfaces of the seal area; and a companion ring abutting the seal and positioned between the bearing pin and the cone cavity in engagement with the annular surfaces of the seal area, wherein an inner diameter surface of the companion ring includes a textured surface engaging the bearing pin surface, wherein the textured surface comprises ceramic.

2. The earth boring bit of claim 1, wherein the textured surface includes a raised ridge between about 5 and 100 microns in height.

3. The earth boring bit of claim 1, wherein the textured surface includes a raised ridge between about 10 and 30 microns in height.

4. The earth boring bit of claim 1, wherein the textured surface comprises a plurality of raised ridges between about 10 and 20 microns in height.

5. The earth boring bit of claim 1, further comprising:

a recess on a side surface of the seal adjacent to the companion ring; and a tab extending outward from the side surface of the companion ring abutting the seal, said tab engaging the recess on the side surface of the seal.

6. The earth boring bit of claim 1, wherein the companion ring comprises two substantially equal sized semicircles.

7. The earth boring bit of claim 1, wherein the width of the companion ring is less than the width of the seal.

8. The earth boring bit of claim 1, wherein the companion ring is not in sealing engagement with the annular surface of the seal area.

9. The earth boring bit of claim 1, wherein the companion ring has a greater hardness than the seal.

10. The earth boring bit of claim 1 wherein the companion ring comprises teflon.

11. The earth boring bit of claim 1 wherein the companion ring comprises elastomer.

12. An earth boring bit, comprising:

a bit body having a depending bearing pin;

a cone having a plurality of cutting elements for engaging a bore hole, the cone having a cavity that rotatably engages the bearing pin; and a groove formed in the cavity of the cone:

a seal in the groove between the bearing pin and the cone, said seal sealingly engaging the bearing pin; and a companion ring abutting the seal in the groove and located on a drilling fluid side of the seal, said companion ring comprising a textured surface on an inner diameter surface of the companion ring, said textured surface comprising ceramic and being in engagement with the bearing pin.

13. The earth boring bit of claim 12, wherein the textured surface comprises a ridge having a height between 5 and 100 microns.

14. The earth boring bit of claim 12, wherein the textured surface comprises a ridge having a height between 10 and 30 microns.

15. The earth boring bit of claim 12 wherein the companion ring comprises two substantially equal sized semicircles.

16. The earth boring bit of claim 12 wherein the companion ring comprises teflon.

17. The earth boring bit of claim 12 wherein the companion ring comprises elastomer.

18. A method of sealing drilling fluid from lubricant in an earth boring drill bit having a cone rotatably mounted on a bearing pin for engaging a borehole, comprising:

providing a seal area between the cone and the bearing pin defined by two annular surfaces, one of which rotates relative to the other, mounting a seal and a companion ring between the annular surfaces, the seal and the companion ring having at least one dynamic seal surface, wherein the companion ring includes a textured surface on the inner diameter surface thereof, wherein the textured surface comprises ceramic;

rotating the cone on the bearing pin within a borehole and sealing drilling fluid in the borehole from lubricant with a dynamic seal surface of the seal and companion ring; and permitting any drilling fluid that contacts the companion ring to migrate past the textured surface into contact with the dynamic seal surface, but blocking with the textured surface at least some debris of the drilling fluid from reaching the dynamic seal surface.

19. The method of claim 18 wherein the companion ring comprises teflon.

20. The method of claim 18 wherein the companion ring comprises elastomer.

* * * * *